US008066079B2

(12) United States Patent
de Boer

(10) Patent No.: US 8,066,079 B2
(45) Date of Patent: Nov. 29, 2011

(54) DRILL STRING FLOW CONTROL VALVES AND METHODS

(75) Inventor: Luc de Boer, Richmond, TX (US)

(73) Assignee: Dual Gradient Systems, L.L.C., Richmond, TX (US)

( * ) Notice: Subject to any disclaimer, the term of this patent is extended or adjusted under 35 U.S.C. 154(b) by 49 days.

(21) Appl. No.: 12/432,194

(22) Filed: Apr. 29, 2009

(65) Prior Publication Data

US 2009/0211814 A1 Aug. 27, 2009

Related U.S. Application Data

(63) Continuation-in-part of application No. 11/788,660, filed on Apr. 20, 2007, now Pat. No. 7,584,801.

(60) Provisional application No. 60/793,883, filed on Apr. 21, 2006.

(51) Int. Cl.
*E21B 21/10* (2006.01)

(52) U.S. Cl. ..... 166/386; 166/321; 175/243; 175/318

(58) Field of Classification Search ..... 166/319, 166/321, 325, 374, 386; 175/318
See application file for complete search history.

(56) References Cited

U.S. PATENT DOCUMENTS

| | | | |
|---|---|---|---|
| 3,090,443 | A | 5/1963 | Bostock |
| 3,973,587 | A | 8/1976 | Cochran |
| 5,174,392 | A | 12/1992 | Reinhardt |
| 5,924,490 | A | 7/1999 | Stone |
| 6,216,799 | B1 | 4/2001 | Gonzalez |

(Continued)

FOREIGN PATENT DOCUMENTS

WO WO 2007/124097 11/2007

OTHER PUBLICATIONS

Gay, Jennifer H., International Search Authority/US, International Search Report, Dec. 26, 2007, 4 pages, United States Patent Office Patent Cooperation Treaty, Alexandria, Virginia.

Gay, Jennifer H., International Search Authority/US, Written Opinion of the International Searching, Dec. 26, 2007, 4 pages, United States Patent Office Patent Cooperation Treaty, Alexandria, Virginia.

International Search Report dated Nov. 3, 2010 issued in WO/2010/127107.

*Primary Examiner* — William P Neuder
*Assistant Examiner* — Robert E Fuller
(74) *Attorney, Agent, or Firm* — Haynes and Boone, LLP

(57) ABSTRACT

Drill string flow control valves and more particularly, drill string flow control valves for prevention of u-tubing of fluid flow in drill strings are provided. Drill string flow control valves may comprise a valve housing, a valve sleeve axially movable within a valve housing from a closed position to an open position, a piston axially movable within said valve housing and bearing against the valve sleeve, a biasing mechanism for biasing the valve sleeve into the closed position, a static pressure port for actuating said piston utilizing internal fluid pressure within said valve and a plurality of dynamic pressure ports for allowing a differential pressure to be exerted on the valve sleeve during dynamic flow conditions. The differential pressure exerted on the valve sleeve may be the result of an upstream pressure and a downstream pressure during fluid flow through said valve. By allowing a differential pressure resulting from a fluid flow to act on the valve sleeve, u-tubing in a drill string can be prevented or substantially reduced. Methods of use are also provided.

47 Claims, 7 Drawing Sheets

U.S. PATENT DOCUMENTS

| | | | | |
|---|---|---|---|---|
| 6,263,981 | B1 | 7/2001 | Gonzalez | |
| 6,401,823 | B1 | 6/2002 | Gonzalez et al. | |
| 7,093,662 | B2 | 8/2006 | de Boer | |
| 2001/0023764 | A1* | 9/2001 | Patel | 166/375 |
| 2002/0020558 | A1 | 2/2002 | Gonzalez | |
| 2007/0084607 | A1 | 4/2007 | Wright et al. | |

* cited by examiner

VALVE OPEN
FLOW PATH SHOWN

DRILL STRING FLOW CONTROL VALVES AND METHODS

RELATED APPLICATION

This application is a continuation-in-part of U.S. patent application Ser. No. 11/788,660, entitled "Drill String Flow Control Valve" filed on Apr. 20, 2007 now U.S. Pat. No 7,584,801, which claims priority to provisional application Ser. No. 60/793,883, filed on Apr. 21, 2006, the disclosures of which are hereby incorporated by reference in full.

BACKGROUND

The present invention generally relates to drill string flow control valves and more particularly, drill string flow control valves for prevention of u-tubing of fluid flow in drill strings and well drilling systems.

Managed Pressure Drilling (MPD) and Dual Gradient Drilling are oilfield drilling techniques which are becoming more common and creating a need for equipment and technology to make them practical. These drilling techniques often utilize a higher density of drilling mud inside the drill string and a lower density return mud path on the outside of the drill string. Examples of such dual gradient drilling techniques are disclosed in U.S. Pat. No. 7,093,662.

In dual gradient drilling, an undesirable condition called "u-tubing" can result when the mud pumps for a drilling system are stopped. Mud pumps are commonly used to deliver drilling mud into the drill string and to extract return mud from the well bore and a return riser (or risers). In a typical u-tubing scenario, fluid flow inside a drill string may continue to flow, even after the mud pumps have been powered down, until the pressure inside the drill string is balanced with the pressure outside the drill string, e.g. in the well bore and/or a return riser (or risers). This problem is exacerbated in those situations where a heavier density fluid precedes a lighter density fluid in a drill string. In such a scenario, the heavier density fluid, by its own weight, can cause continued flow in the drill string even after the mud pumps have shut off. This u-tubing phenomenon, can result in undesirable well kicks, which can cause damage to a drilling system. For this reason, it is desirable that when mud pumps in a drilling system are turned off, the forward fluid flow be discontinued quickly.

SUMMARY

The present invention generally relates to drill string flow control valves and more particularly, drill string flow control valves for prevention of u-tubing of fluid flow in drill strings and well drilling systems.

The drill string flow control valve of the present invention utilizes the pressure differential between certain pressure ports positioned to apply pressure to opposing pressure surfaces of a valve sleeve slidingly mounted within a valve housing to control operation of the drill string flow control valve when fluid is flowing through the valve. To further control the valve, a pressure flow port is positioned to generate pressure on the surface of a piston acting against the valve sleeve so as to initiate movement of the valve sleeve to an valve open position. More specifically, a drill string flow control valve may comprise a valve housing, a valve sleeve axially movable within a valve housing from a closed position to an open position, a valve piston axially movable within the valve housing and bearing against the valve sleeve, a biasing mechanism for biasing the valve sleeve into the closed position, and a plurality of pressure ports for allowing a differential pressure to be exerted on the valve sleeve during dynamic flow through the valve. A differential pressure exerted on the valve sleeve may be the result of an upstream pressure and a downstream pressure. By allowing a differential pressure resulting from a fluid flow to act on the valve sleeve during dynamic flow, u-tubing in a drill string can be prevented or substantially reduced.

One example of a drill string flow control valve comprises a valve housing wherein the valve housing has a housing flow path from a housing flow inlet to a housing outlet flow port; a valve sleeve disposed at least partially in the valve housing, the valve sleeve characterized by an outer diameter and having a sleeve flow port defined within a wall of the sleeve, wherein the valve sleeve is axially movable within the valve housing from a closed position to an open position, such that the sleeve wall substantially impedes fluid flow from the housing outlet flow port into the interior of the sleeve when the valve sleeve is in the closed position and wherein the sleeve flow port allows fluid flow from the housing outlet flow port to the interior of the sleeve when in the open position; wherein the valve sleeve has an upper pressure surface defined thereon so as to provide a first surface area upon which a first fluid pressure may act to provide a downward force on the valve sleeve and wherein the valve sleeve has a lower pressure surface defined thereon so as to provide a second surface area upon which a second fluid pressure may act to provide an upward force on the valve sleeve; an elongated piston body axially movable within the valve housing and bearing against the valve sleeve, wherein the piston body has a piston pressure surface characterized by a piston surface area that is smaller than the first surface area of the sleeve and wherein the piston body has an outer diameter smaller than the outer diameter of the sleeve; a spring wherein the spring biases the valve sleeve to the closed position by exertion of a biasing force on the valve sleeve; a piston pressure port that allows the first fluid pressure to act upon the piston pressure surface; an upper pressure port that allows the first fluid pressure to act upon the upper pressure surface; and a lower pressure port that allows the second fluid pressure to act upon the lower pressure surface from external the valve housing.

Another example of a drill string flow control valve comprises a valve housing characterized by a wall defining a valve interior, wherein the valve housing has an interior housing flow path from a housing flow inlet to a housing outlet flow port; a valve sleeve disposed at least partially in the valve housing, the valve sleeve having a sleeve flow port wherein the valve sleeve is axially movable within the valve housing from a closed position to an open position, such that the wall defining the sleeve substantially impedes fluid flow from the housing outlet flow port to the interior of the valve sleeve when the valve sleeve is in the closed position and wherein the sleeve flow port allows fluid flow from the housing outlet flow port to the interior of the valve sleeve when in the open position; wherein the valve sleeve has an upper pressure surface defined thereon so as to provide a first surface area upon which a first fluid pressure may act to provide a downward force on the valve sleeve and wherein the valve sleeve has a lower pressure surface defined thereon so as to provide a second surface area upon which a second fluid pressure may act to provide an upward force on the valve sleeve; an elongated cylinder having a first end and a second end, wherein the second end abuts the valve sleeve; a biasing mechanism wherein the biasing mechanism biases the valve sleeve to the closed position; a piston pressure port that allows the first fluid pressure to act upon the first end of the elongated cylinder from the housing flow path; an upper pressure port that allows the first fluid pressure to act upon the upper pressure surface; and a lower pressure port that allows the second fluid pressure to act upon the lower pressure surface from external the valve housing.

An example of a method for preventing u-tubing in a drill string comprises providing a valve housing characterized by a wall defining a valve interior, wherein the valve housing has an interior housing flow path from a housing flow inlet to a housing outlet flow port; providing a valve sleeve disposed at least partially in the valve housing, the valve sleeve having a sleeve flow port wherein the valve sleeve is axially movable within the valve housing from a closed position to an open position, such that a wall of the sleeve at least partially impedes fluid flow from the housing outlet flow port to the interior of the sleeve when the valve sleeve is in the closed position and wherein the sleeve flow port allows increased fluid flow from the housing outlet flow port to the interior of the sleeve when in the open position, wherein the valve sleeve has an upper pressure surface defined thereon so as to provide a first surface area upon which a first fluid pressure may act to provide a downward force on the valve sleeve and wherein the valve sleeve has a lower pressure surface defined thereon so as to provide a second surface area upon which a second fluid pressure may act to provide an upward force on the valve sleeve; providing a biasing mechanism wherein the biasing mechanism biases the valve sleeve to the closed position by exerting a biasing spring force on the valve sleeve; providing an upper pressure port that allows the first fluid pressure to act upon the upper pressure surface from the interior of the valve housing; providing a lower pressure port that allows the second fluid pressure to act upon the lower pressure surface from exterior the valve housing with a lower force; increasing a fluid pressure upon the valve sleeve so as to cause the valve sleeve to shift from the closed position to the open position; maintaining a fluid flow through the valve sleeve so that the upper force is greater than the biasing spring force plus the lower force; and decreasing the fluid flow through the valve sleeve so as to allow the biasing mechanism to shift the valve sleeve from the open position to the closed position.

An example of a drill string flow control valve system comprises a valve housing characterized by a wall defining an interior of the valve housing, wherein the valve housing has a housing flow path within its interior from a housing flow inlet to a housing outlet flow port; a valve sleeve disposed at least partially in the valve housing, the valve sleeve having a sleeve flow port defined within a wall of the sleeve, wherein the valve sleeve is axially movable within the valve housing from a closed position to an open position, such that the sleeve wall at least partially limits fluid flow from the housing outlet flow port to the sleeve flow port when the valve sleeve is in the closed position and wherein the sleeve flow port and the housing outlet flow port are in substantial alignment when in the open position; wherein the valve sleeve has an upper pressure surface defined thereon so as to provide a first surface area upon which a first fluid pressure may act to provide a downward force on the valve sleeve and wherein the valve sleeve has a lower pressure surface defined thereon so as to provide a second surface area upon which a second fluid pressure may act to provide an upward force on the valve sleeve; a biasing mechanism wherein the spring biases the valve sleeve to the closed position by exertion of a biasing force on the valve sleeve; a flow restriction defined in the valve sleeve; an upper pressure port that allows the first fluid pressure to act upon the upper pressure surface wherein the first fluid pressure is measured upstream of the flow restriction; and a lower pressure port that allows the second fluid pressure to act upon the lower pressure surface from external the valve housing wherein the second fluid pressure is measured downstream of the flow restriction.

Another embodiment of a drill string flow control valve comprises a valve housing characterized by a wall defining an interior of the valve housing, wherein the valve housing interior has a housing flow path from a housing flow inlet to a housing outlet flow port; a valve sleeve disposed at least partially in the valve housing, the valve sleeve having a sleeve flow port defined within a wall of the sleeve, wherein the valve sleeve is axially movable within the valve housing from a closed position to an open position, such that the sleeve wall at least partially impedes fluid flow from the housing outlet flow port into the interior of the sleeve when the valve sleeve is in the closed position and wherein the sleeve flow port and the housing outlet flow port are substantially aligned when in the open position; wherein the valve sleeve has an upper pressure surface defined thereon so as to provide a first surface area upon which a first fluid pressure may act to provide a downward force on the valve sleeve and wherein the valve sleeve has a lower pressure surface defined thereon so as to provide a second surface area upon which a second fluid pressure may act to provide an upward force on the valve sleeve; an upper pressure port that allows the first fluid pressure to act upon the upper pressure surface from the interior of the valve housing; and a lower pressure port that allows the second fluid pressure to act upon the lower pressure surface from the exterior of the valve housing.

Yet another example of a drill string flow control valve system comprises a valve housing characterized by a housing wall having an internal surface and an external surface and a internal flow path defined wholly within the housing wall; a valve sleeve slidingly mounted in the valve housing; a biasing mechanism for biasing the valve sleeve in a closed position; a first pressure port acting on a first portion of the sleeve and in fluid communication with the first flow path; and a second pressure port acting on a second portion of the sleeve, said second pressure port extending through the housing wall from the internal surface to the external surface of the valve housing.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
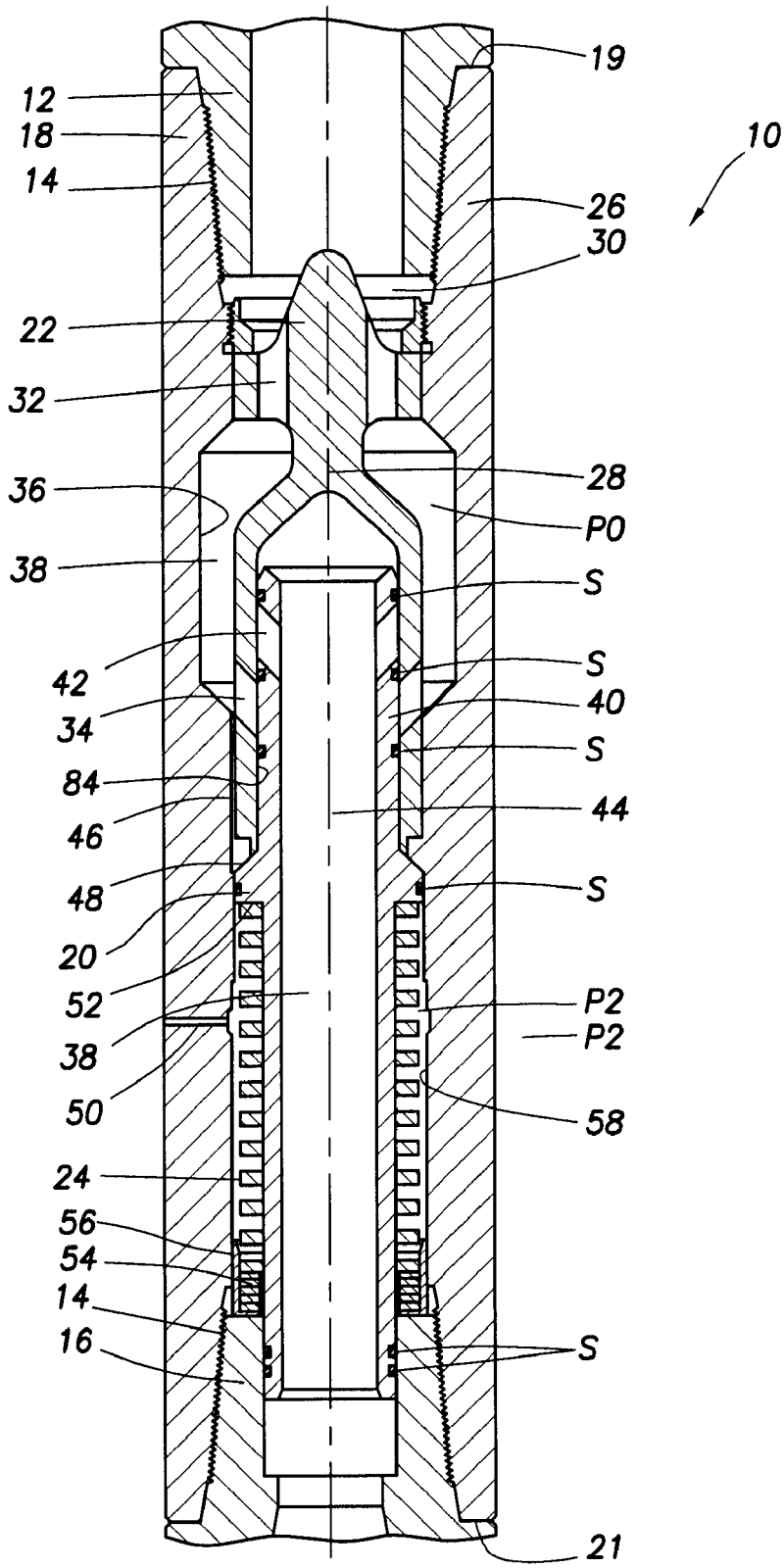
FIG. 1 illustrates a cross-sectional view of a drill string flow control valve.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present invention generally relates to drill string flow control valves and more particularly, drill string flow control valves for prevention of u-tubing of fluid flow in drill strings and well drilling systems.

Drill string flow control valves are provided herein that, among other functions, can be used to reduce and/or prevent u-tubing effects in drill strings.

To facilitate a better understanding of the present invention, the following examples of certain embodiments are given. In no way should the following examples be read to limit, or define, the scope of the invention.

For ease of reference, the terms "upper," "lower," "upward," and "downward" are used herein to refer to the spatial relationship of certain components. The terms "upper" and "upward" refer to components towards the surface (distal to the drill bit), whereas the terms "lower" and "downward" refer to components towards the drill bit (or proximal to the drill bit), regardless of the actual orientation or deviation of the wellbore or wellbores being drilled. The term "axial" refers to a direction substantially parallel to the drill string in proximity to a drill string flow control valve.

FIG. 1 illustrates a cross-sectional view of a drill string flow control valve in accordance with one embodiment of the present invention. Drill string flow control valve 10 is shown inline in a drill string, connected at drill pipe threads 14 to upper sub 12 and lower sub 16. Drill string flow control valve 10 may be installed in the drill string at any point in the drill string above the drill bit. One or more components such as drill pipe joints/sections, MWD components, heavy-walled drill pipe, or any number BHA components may be installed between drill string flow control valve 10 and the drill bit. Drill string flow control valve 10 is generally comprised of a valve housing 18 and a valve sleeve 20 slidingly mounted therein. Drill string control 10 may also include ported plug 22 to direct fluid flow within valve housing 18. Although valve housing 18 and ported plug 22 are shown here as two or more components, in certain embodiments, these two components may be formed as one integral piece such that ported plug 22 is simply a part of valve housing 18. For purposes of the invention, they will be described as an integral piece. Valve sleeve 20 is disposed in valve housing 18 and is axially slidable or movable within valve housing 18. In one embodiment, valve sleeve 20 may be partially disposed within a portion of ported plug 22.

Valve sleeve 20 is biased upwards by spring 24. Valve housing 18 has an upper end 19 and a lower end 21 and is characterized by a housing wall 26 extending therebetween so as to define an interior 28 of valve 10 extending from upper end of 19 to lower end 21. Within the interior 28 of valve 10 is defined a flowpath 38 for the flow of drilling fluids and the like through valve 10. Valve 10 includes an inlet flow port 32 and an outlet flow port 34 with a passage 36 formed therebetween so as to define a portion of fluid flow path 38 along which fluid may flow. Valve sleeve 20 is characterized by a valve sleeve wall 40 in which a sleeve flow port 42 is defined. In FIG. 1, sleeve flow port 42 of valve sleeve 20 is not aligned with housing outlet flow port 34. Therefore, in the configuration shown here, fluid flow through housing outlet flow port 34 and sleeve flow port 42 from passage 36 into the interior 44 of valve sleeve 20 is inhibited because valve sleeve wall 40 is blocking the fluid flow path 38 (i.e. the closed position of drill string flow control valve 10). As will be explained herein, valve sleeve 20 is capable of sliding downward so that housing outlet flow port 34 may align with sleeve flow port 42 to allow fluid to flow through drill string flow control valve 10 (i.e. the open position).

In valve 10, under static conditions, i.e., when there is substantially no fluid flow along flow path 38 through valve 10, those skilled in the art will appreciate that a static fluid pressure P0 exists inside valve 10. Likewise, in valve 10, under dynamic conditions, i.e., when there is substantial fluid flow along flow path 38 through valve 10, those skilled in the art will appreciate that a first fluid pressure P1 exists inside valve 10 and a second fluid pressure exists in the wellbore, outside of the drill string in which valve 10 is installed. P2 is commonly referred to as the wellbore pressure. In any event, under dynamic conditions, because of restrictions in the internal flow path within the drill string, such as the drill bit, the internal drill string pressure P1 is higher than the wellbore pressure P2.

With this in mind, an upper pressure port 46 is defined in the interior of valve housing 18 and extends from any point along flow path 38 to allow fluid pressure P1 from the interior 28 of valve housing 18 to be communicated from a point along flow path 38 to upper pressure surface 48. In certain embodiments, upper pressure surface 48 may be a protrusion, extension, and/or cross-sectional surface area of valve sleeve 20 upon which a fluid pressure may act so as to provide a downward acting axial force on valve sleeve 20. In another embodiment, upper pressure surface 48 may be defined as the top of valve sleeve 20. In any event, as fluid pressure P1 increases on upper pressure surface 48, valve sleeve is urged downward by fluid pressure P1 acting against the upward bias force of spring 24. Thus, a sufficient fluid pressure acting upon upper pressure surface 48 induces valve sleeve 20 to slide downward. Given sufficient downward force on valve sleeve 20, sleeve flow port 42 will be at least partially aligned with housing outlet flow port 34 so as to allow fluid flow to pass through drill string flow control valve 10 along flow path 38.

Consequently, fluid flow along flow path 38 is thus permitted to pass through drill string flow control valve 10. The fluid flow eventually passes through a drill bit (not shown) and out and upward into the annulus of the well bore to return the drilling mud to the surface. During normal or high flow conditions, a typical drilling mud flow rate will result in a marked pressure drop across the drill bit as the fluid passes through the drill jets of the drill bit. As such, the fluid pressure P2 in the wellbore external to valve 10, i.e., on the exterior of valve housing 18, will be lower than the pressure P1 anywhere along the flowpath 38 on the interior of valve housing 18. Thus, at any given level of the drill string, the fluid pressure P2 measured in the annulus will be lower than the fluid pressure P1 inside drill string flow control valve 100 on account of the pressure drop that results from the fluid flowing from inside the drill string to the outer annulus. This pressure drop characterized by P1-P2 is usually attributable in large part to the pressure drop experienced across the drill jets of the drill bit.

Lower pressure port 50 allows the fluid pressure P2 in the annulus to be communicated to lower pressure surface 52. Lower pressure surface 52 may be a protrusion, extension, and/or cross-sectional surface area of valve sleeve 20 upon which a fluid pressure may act so as to provide an upward acting axial force on valve sleeve 20. Likewise, lower pressure surface 52 may also be defined as the bottom of valve sleeve 20. In the illustrated embodiment, upper pressure surface 48 and lower pressure surface 52 are defined on the same protrusion. In any event, the fluid pressure P2 in the annulus is allowed to provide an upward force on valve sleeve 20 by acting upon lower pressure surface 52. In this way, both the biasing force of spring 24 and the fluid pressure P2 of the annulus counteract the downward force provided by fluid pressure P1 on upper pressure surface 20. During normal flow conditions, drill string flow control valve 10 is designed so that the fluid flow along flowpath 38 through drill string flow control valve 10 and the drill bit will result in a pressure drop P1-P2 such that the pressure drop P1-P2 will provide a differential pressure acting upon valve sleeve 20 (via upper pressure surface 48 and lower pressure surface 52) sufficient to overcome the upward force of spring 24 and keep valve sleeve 20 in the open or substantially open position.

Once the fluid pumps delivering drilling mud to the drill string are shut down and fluid flow decreases, the pressure differential P1-P2 will quickly drop. Pressure differential P1-P2 will no longer be a sufficient to overcome the biasing force of spring 24 and accordingly, valve sleeve will be motivated upwards to a closed position, thus impeding or substantially impeding fluid flow through drill string flow control valve 10. Alternatively, fluid pressure P1 may be adjusted as desired so as to adjust the relative position of sleeve 20 within housing 18 such that ports 24 and 42 are only partially aligned, hence permitting control of the volume of fluid passing along flow path 38 when valve 10 is not in the fully closed position.

Adjustment shims 54 and shim sleeves 56 may be provided to adjust the compression of spring 24. By altering the compression of spring 24, the biasing force of spring 24, and hence the operating parameters of valve 10, may be adjusted for different operating conditions. In an alternative embodiment, the inner diameter 58 of valve housing 18 adjacent spring 24 may be increased to accommodate a larger spring. Alternatively, the surface area of the upper pressure surface 48 and/or lower pressure surface 52 may be altered to adjust the operating parameters of valve 10. Operating conditions and parameter to which drill string flow control valve 10 is subjected include, but are not limited to, desired flow rates, fluid densities, depth of drill string flow control valve 10, and expected pressure differentials through the drill bit. Design variables of drill string flow control valve 10 that may be adjusted include, but are not limited to, inner and outer diameters of drill string flow control valve 10, the spring constant (e.g. by changing the wire length, wire diameter, wire material, wire angle, wire pitch, etc.), the size of the flow ports, and the pressure drop through drill string flow control valve 10.

Optional seals S are provided at the indicated locations to prevent leakage of fluid and to prevent communication of fluid pressures to undesired sites around valve sleeve 20.

Although upper pressure surface 48 and lower pressure surface 52 are depicted here as one integral piece, it is explicitly recognized that both surfaces may be composed of separate extensions protruding from valve sleeve 20.

Figure 2A:
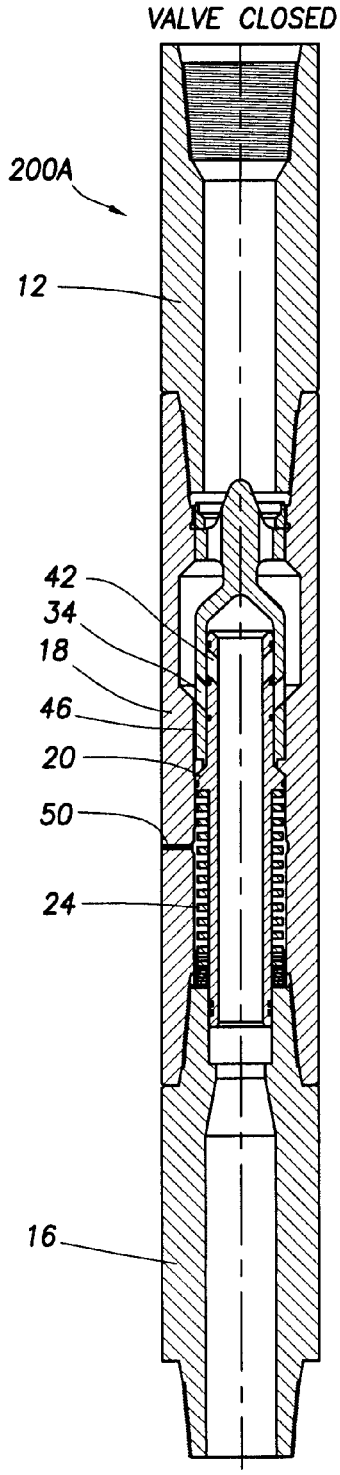
FIGS. 2A and 2B illustrate a cross-sectional view of a drill string flow control valve shown in a closed position and an open position.
Figure 2B:
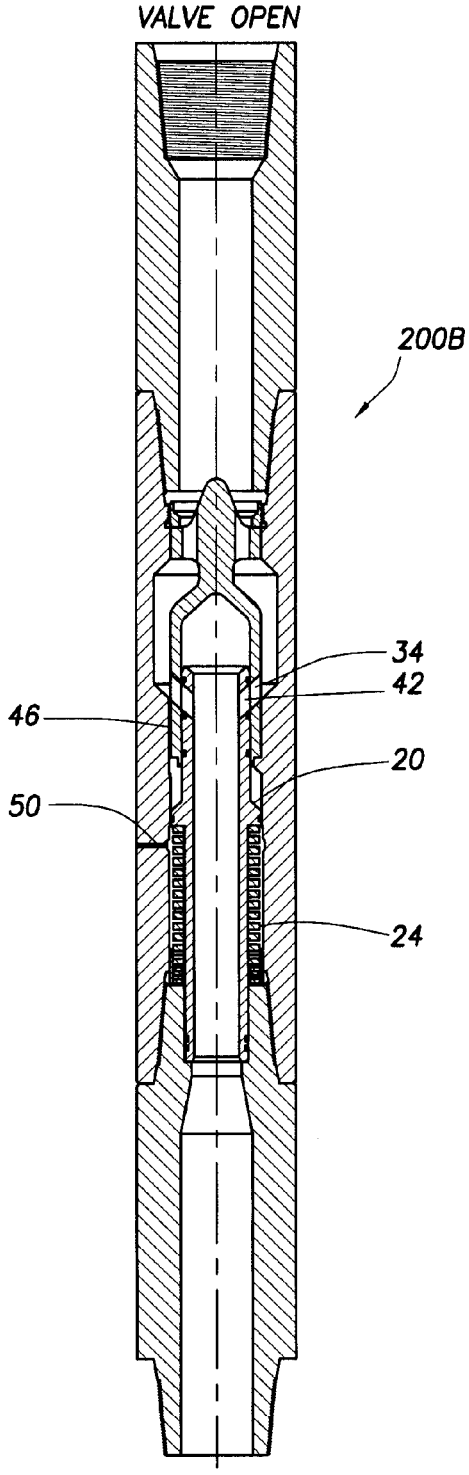

FIG. 2 illustrates a cross-sectional view of a drill string flow control valve shown in both a closed position and an open position. More specifically, drill string flow control valve 200A is shown in the closed position, and drill string flow control valve 200B is shown in the open position.

Drill string flow control valve 200A is shown inline a drill string as attached to upper sub 12 and lower sub 16. Here, valve sleeve 20 is biased in an upward or closed position by spring 24 and consequently, housing outlet flow port 34 and sleeve flow port 42 are out of alignment. Drill string flow control valve 200B, however, is shown in the open position as valve sleeve 20 is biased downward against compressed spring 24 and consequently, housing outlet flow port 34 and sleeve flow port 42 are in substantially alignment.

Figure 3:
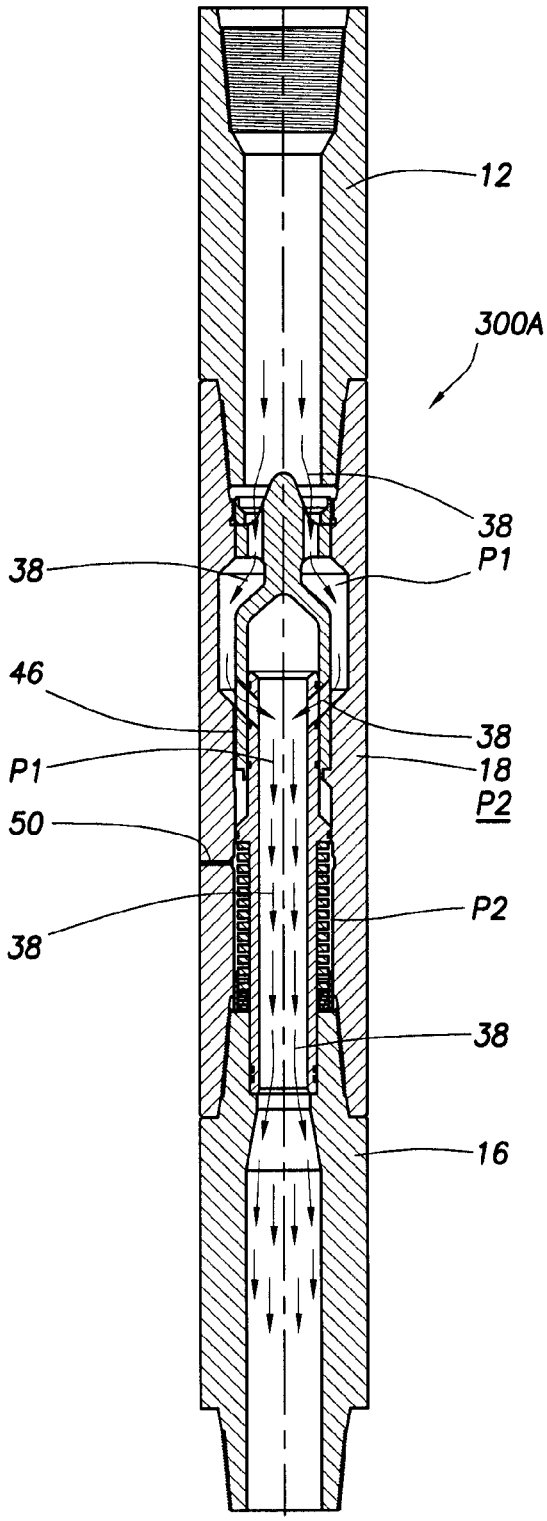
FIG. 3 illustrates a cross-sectional view of a drill string flow control valve shown in a closed position and an open position with flow arrows showing a fluid flow path.

FIG. 3 illustrates a cross-sectional view of a drill string flow control valve shown in an open position with fluid flowing along flow path 38. The flow arrows indicated in drill string flow control valve 300A indicate the normal fluid flow path 38 when drill string flow control valve 300A is in the open position.

Figure 4:
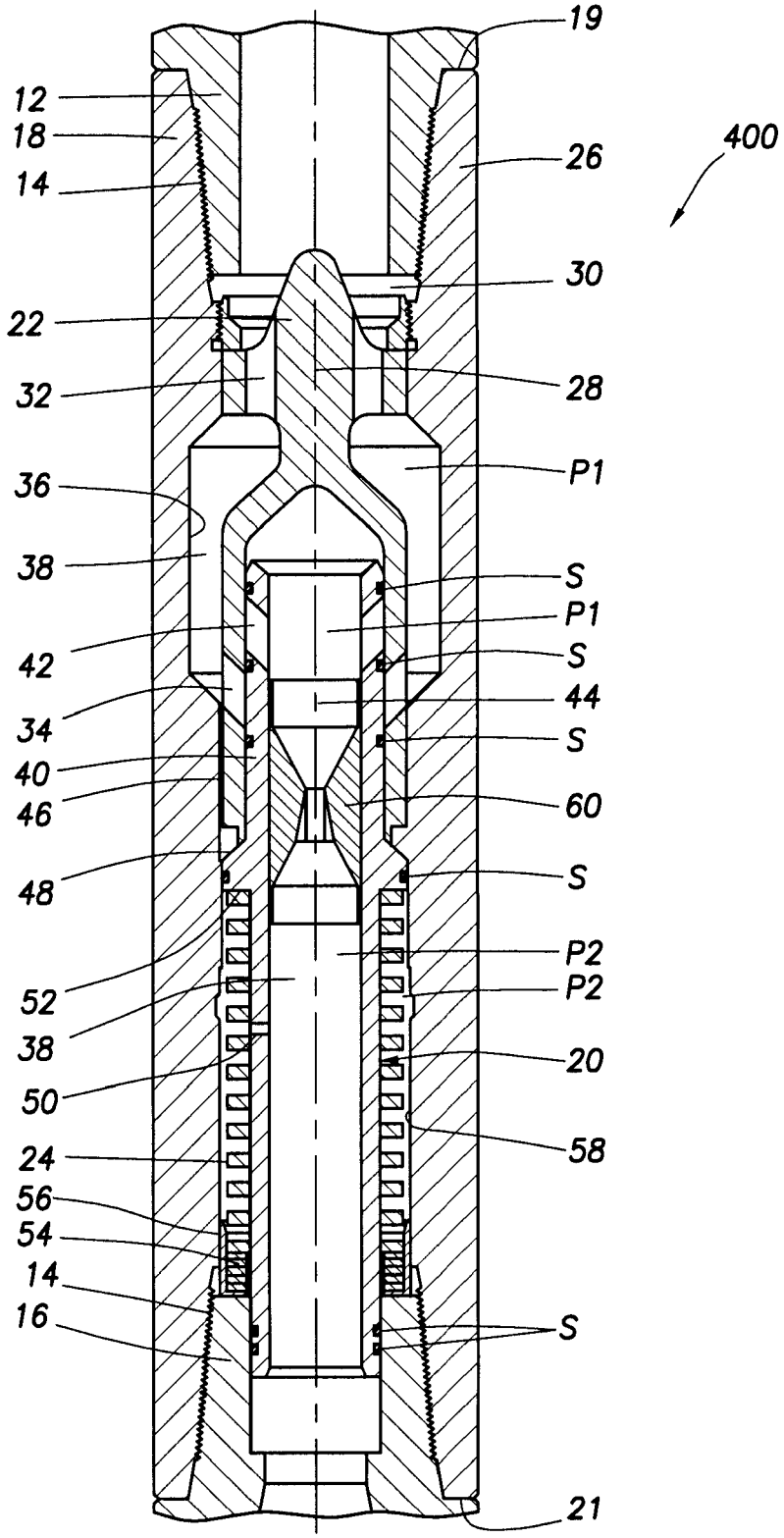
FIG. 4 illustrates a cross-sectional view of a drill string flow control valve having an internal jet.
Figure 5E:
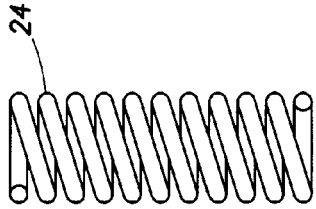
FIGS. 5A-5B illustrate several components of one embodiment of a drill string flow control valve shown apart in a disassembled manner.
Figure 5F:
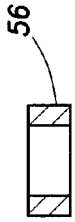
Figure 5C:
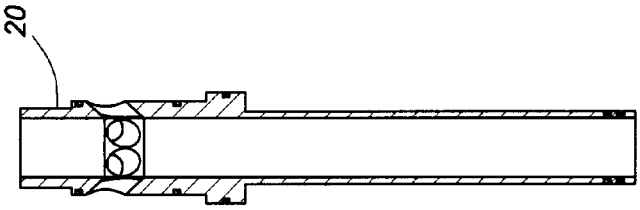
Figure 5D:
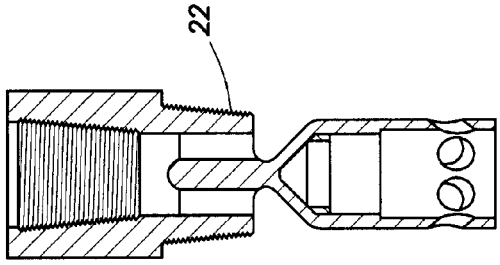
Figure 5B:
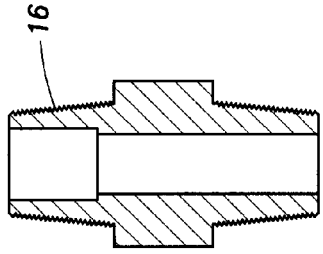
Figure 5A:
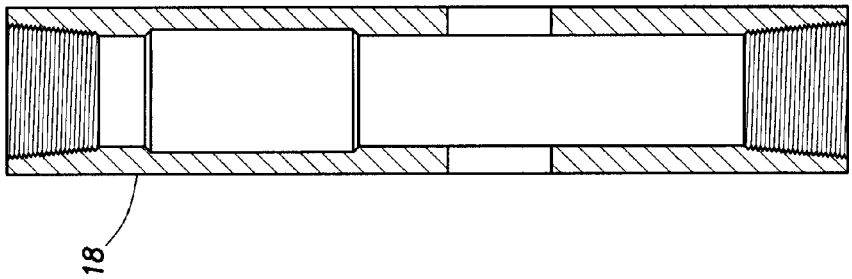

FIG. 4 illustrates a cross-sectional view of a drill string flow control valve having internal jet 60. The embodiment depicted in FIG. 4 is similar to the embodiment of FIG. 1 with the exception of the addition of jet 60 and a modification of the placement of lower pressure port 50 due to the presence of jet 60 and its effect on the pressure within sleeve 20. In this embodiment of FIG. 4, fluid flow through valve sleeve 20 is guided through a restriction or jet 60. Jet 60 may be any device suitable for producing a measurable pressure drop P1-P2. Thus, fluid flow passing through jet 60 will experience a pressure drop P1-P2 as the fluid passes through jet 60 such that pressure P2 will be lower than pressure P1. Indeed, under most circumstances, the pressure drop P1-P2 will vary proportional to the fluid flow except under certain choked flow conditions. Since the purpose of lower pressure port 50 is to communicate pressure P2 to lower pressure surface 52, in the embodiment of FIG. 4, lower pressure port 50 need not extend into the annulus of the wellbore, but rather extends through sleeve 20 below jet 60. In the instant case, rather than characterizing flow path 38 as extending from the upper end 19 to the lower end 21 of valve housing 18, flow path 38 extends from the upper end 19 of valve housing 18 to jet 60. Those skilled in the art will appreciate that for the purposes of the invention, flowpath 38 is intended to embody that portion of the fluid flow that remains substantially the same pressure along the flow path. Jet 60 will result in a pressure drop and thus represents the end of the flowpath 38 for purposes of the description of this embodiment. In any event, lower pressure port 50 allows pressure P2 to be communicated to lower pressure surface 52 to provide an upward force on valve sleeve 20. As before in FIG. 1, upper pressure port 46 allows pressure P1 to be communicated to upper pressure surface 48 to provide a downward force on valve sleeve 20. Those skilled in the art will appreciate that upper pressure port 46 may be situated at any point above jet 60 so long as it communicates the pressure P1 along flowpath 38 to the upper pressure surface 48. In this way, pressure differential P1-P2 acts on valve sleeve 20 to provide a net biasing force on valve sleeve 20 to counteract the biasing force of spring 24.

As before in FIG. 1, as fluid flow rate through valve sleeve 20 increases, the net biasing force acting on valve sleeve 20 motivates the sleeve towards the open position. A decrease in fluid flow, on the other hand, motivates valve sleeve 20 towards the closed position. One of the advantages of the embodiment of FIG. 4 is the benefit that only clean fluid enters the region of spring 24 between valve sleeve 20 and outer valve housing 18. In the embodiment of FIG. 1, however, drilling mud from the annulus can enter the region of spring 24 between valve sleeve 20 and outer valve housing 18. The drilling mud from the annulus may contain additional drill bit cuttings and debris from the formation, which may cause fouling problems in the region of spring 24.

Here, upper pressure surface 48 and lower pressure surface 52 are depicted as one extension from valve sleeve 20 such that both surfaces or cross-sectional surface areas are formed integrally from one piece or extension of valve sleeve 20. In certain embodiments, however, an upper pressure surface and a lower pressure surface may be formed by separate extensions apart from one another as desired. In such a scenario, it is recognized that an upper pressure surface and lower pressure surface may provide surface areas of different cross-sectional areas. Thus, in this alternative embodiment, pressure P1 would act upon a surface area of an upper pressure surface of a first cross-sectional area whereas pressure P2 would act upon a surface area of a lower pressure surface of a second cross-sectional area.

Additionally, although spring 24 is depicted in the various embodiments as acting upon lower pressure surface 52, it is explicitly recognized that spring 24 may act upon any extension of valve sleeve 20 or alternatively, may attach to valve sleeve 20 by any means known in the art, including any known attachment or bonding method known in the art. Thus, in certain embodiments of drill string flow control valve 400, pressure P1 could act upon an upper pressure surface that is distinct and apart from a lower pressure surface upon which pressure P2 acts. Spring 24 may act upon either the upper pressure surface or the lower pressure surface or upon an entirely different pressure surface of valve sleeve 20, or by any attachment of spring 24 to valve sleeve 20 that would allow communication of the potential energy of spring 24 to valve sleeve 20, or any combination thereof. In other embodiments, spring 24 may be disposed to act on another portion of sleeve 20 so long as spring 24 biases valve sleeve 20 into a "closed" position.

The net downward biasing force on valve sleeve 20 may be described by an equation that accounts for the various pressures in the system acting upon the relevant surface areas while taking into account the force exerted by the spring. Additionally, it is clear that the characteristics of the system will also be influenced by the hydrostatic pressure resulting from the depth of the drill string flow control valve and the relevant fluid densities used.

Additionally, in certain embodiments, upper pressure port 46 may communicate any upstream pressure P1 to upper pressure surface 48 while lower pressure port 50 communicates any downstream pressure P2 to lower pressure surface 52. The term "downstream pressure," as used herein, refers to any pressure measured downstream a flow restriction that produces a measurable fluid flow pressure drop after the flow restriction. The term "upstream pressure," as used herein, refers to any pressure measured upstream of the same flow restriction. Examples of suitable flow restrictions include, but are not limited to jets, venturi nozzles, a flow orifices, drill bit jets, any length of piping sufficient to create a measurable pressure drop, or any combination thereof. Further, it is recognized that the communication of pressures from one location to another in the systems described herein may be accomplished with a plurality of ports even though only one port may be described in certain embodiments.

FIG. 5 illustrates several components of one embodiment of a drill string flow control valve shown apart in a disassembled manner. For clarity, several of the components of one embodiment of a drill string flow control valve are shown apart in a disassembled view in FIG. 5. The components, shown apart here, include valve housing 18, ported plug 22, lower sub 16, valve sleeve 20, spring 24, and shim sleeve 56.

Figure 6A:
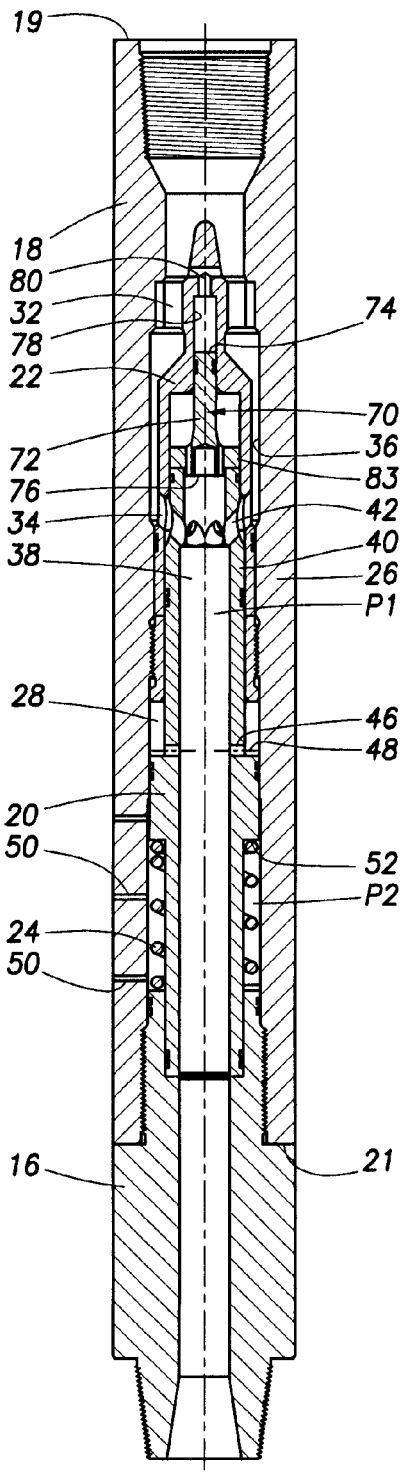
FIGS. 6A-6B illustrate an embodiment of the invention incorporating a separate piston used to initiate opening of the drill string flow control valve, shown in both the closed position and an open position.
Figure 6B:
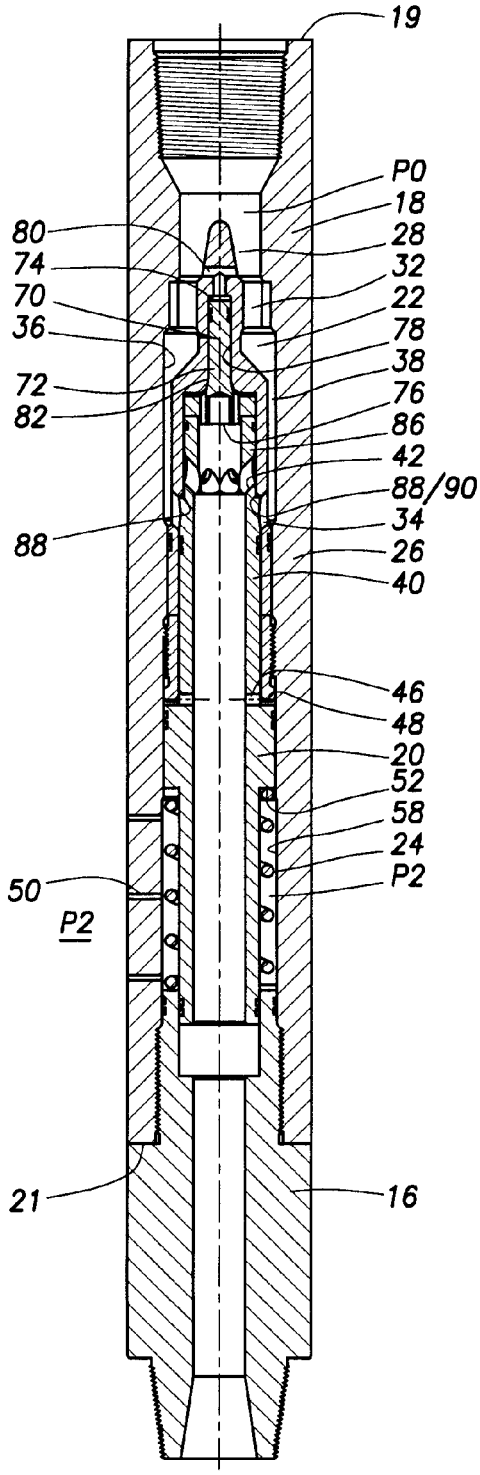

Turning to FIG. 6, another embodiment of the invention is illustrated in which a piston 70 is provided to assist in the opening of valve 10, particularly under static valve conditions, i.e., prior to initiation of substantial flow through valve 10. Specifically, piston 70 is comprised of an elongated, cylindrical body 72 having a first end 74 and a second end 76. Second end 76 of piston 70 abuts valve sleeve 20. First end 74 of piston 70 rides in a piston cylinder 78 defined in valve housing 18. Piston 70 is axially slidable or movable within valve housing 18.

A piston pressure port 80 is provided in valve housing 18 and extends from a point along flowpath 38 to piston cylinder 78 so as to communicate the static pressure P0 within valve 10 to the pressure surface at the first end 74 of piston 70. In embodiments utilizing a plug 22, the piston pressure port 80 may be provided in the plug.

In this preferred embodiment, the contact surface area between piston 70 and cylinder 78 is minimized relative to the contact surface area between sleeve 20 and valve housing 18 because of the size of piston 70, thereby reducing the friction between components that needs to be overcome when valve 10 is initially opened. Specifically, the outer diameter of body 72 is less than, and preferably significantly less than, the outer diameter of valve sleeve 20. Thus, the force needed to overcome the friction or "sticking force" between cylindrical body 72 and piston cylinder 78 (as at 82 of FIG. 1) is less than the force needed to overcome the friction or "sticking force" between valve sleeve 20 and the wall 26 of valve housing 18 (as at 84 of FIG. 1).

This embodiment is desirable because it permits valve 10, and in particular, valve sleeve 20, to be more easily opened against the closing force of spring 24. In other words, piston 70 is utilized to "crack open" valve 10 upon initiation of fluid flow by facilitating downward movement of sleeve 20 when fluid flow through valve 10 is first begun.

In the embodiment of FIG. 6, upper pressure port 46 extends through wall 40 of sleeve 20 in order to communicate pressure P1 to upper pressure surface 48. Since piston pressure port 80 is provided to facilitate initial "opening" of sleeve 20, upper pressure port 46 need not perform this function as in the embodiments of FIGS. 1-5, but is utilized only to adjust the relative "open" position of sleeve 20 once some fluid flow through valve 10 has been initiated. As such, upper pressure port 46 need not be bled off of flow path 36 upstream of housing outlet flow port 34 as in the embodiments of FIGS. 1-5, but can be bled off of flow path 36 at any point along flow path 36 so long as upper pressure port 46 communicates pressure P1 to upper pressure surface 48.

Figure 7A:
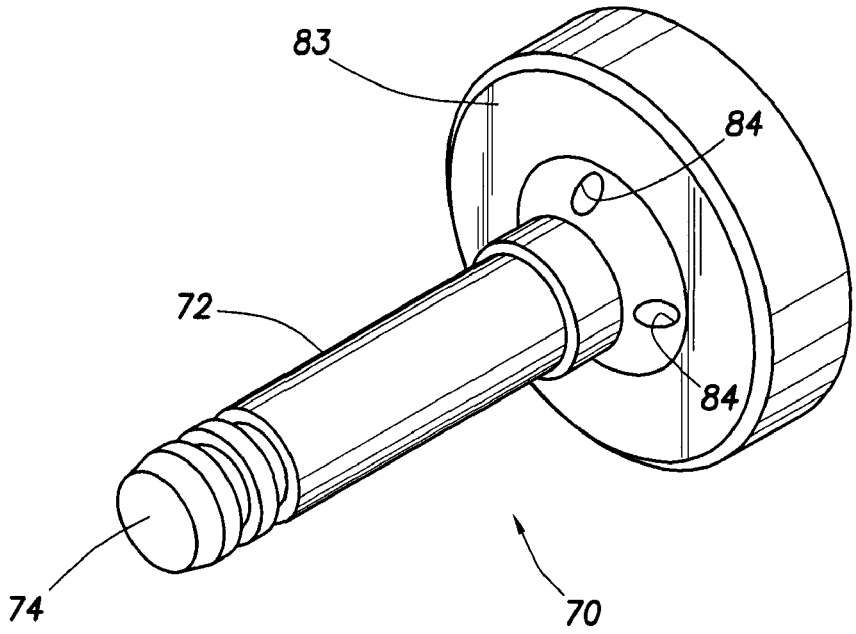
FIG. 7 illustrates the piston of the embodiment of FIG. 6.
Figure 7B:
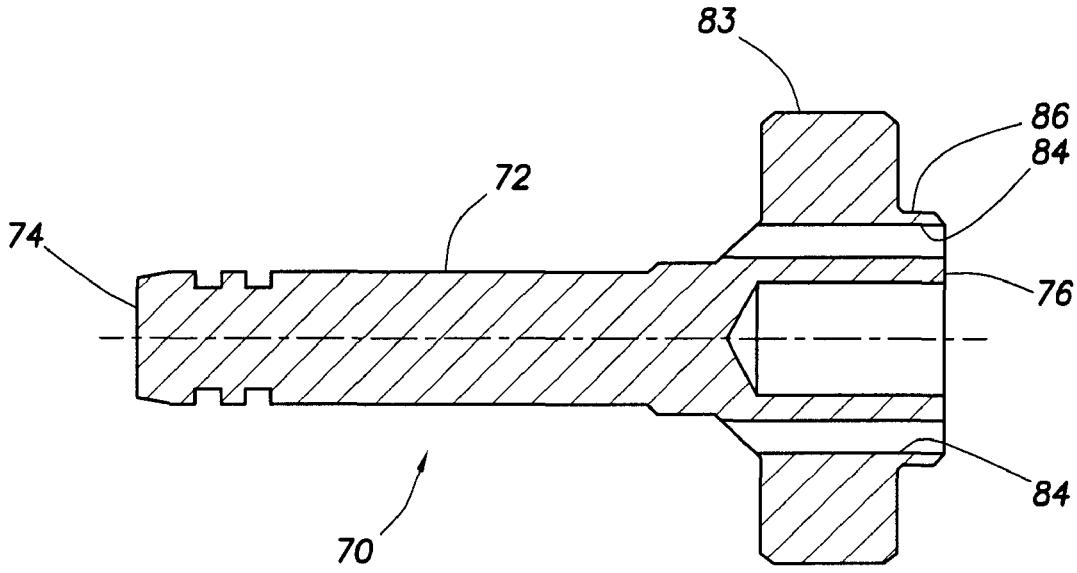

With reference to FIGS. 6 and 7, while not necessary, the second end 76 of piston 70 may have an increased diameter, such as flange 83, substantially the same as the diameter of the abutting end of sleeve 20, to maintain the axial alignment of piston 70 relative to sleeve 20. In such an embodiment, one or more throughbores 84 may be provided to facilitate axial movement of piston 70. Moreover, second end 76 may be provided with a shoulder 86 or similar structure to engage the end 86 of sleeve 20.

Additionally, the end 86 of sleeve 20 may include a reduced diameter so as to form a shoulder 88 which can seat against a corresponding shoulder 90 formed within valve housing 18, thereby facilitating the sealing of housing outlet flow port 34 when valve 10 is in a static position.

Although drill pipe threads have been depicted herein in several embodiments, it is explicitly recognized that the drill string flow control valves, the joints of drill pipe, and other drill string components herein may be attached to one another by any suitable means known in the art including, but not limited to, drill pipe threads, ACME threads, high-torque shoulder-to-shoulder threads, o-ring seals, welding, or any combination thereof.

While the foregoing has been described in relation to a drill string and is particularly desirable for addressing u-tubing concerns, those skilled in the art with the benefit of this disclosure will appreciate that the drill string flow control valves of the present invention can be used in other fluid flow applications without limiting the foregoing invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A drill string flow control valve comprising:

a valve housing characterized by a wall defining a valve interior, wherein the valve housing has an internal housing flow path formed therein with a housing outlet flow port disposed along said internal housing flow path;

a valve sleeve disposed at least partially in the interior of the valve housing, the valve sleeve characterized by a first end and a second end and a wall defining a sleeve interior, a sleeve flow port defined within the valve sleeve wall, wherein the valve sleeve is axially movable within the valve housing between a closed position and an open position, such that the valve sleeve wall substantially impedes fluid flow from the housing outlet flow port to the sleeve flow port when the valve sleeve is in the closed position and wherein the sleeve flow port and the housing outlet flow port are in substantial alignment when in the open position;

wherein the valve sleeve has an upper pressure surface defined thereon so as to provide a first surface area upon which a first fluid pressure from the internal housing flow path may act to provide a downward force on the valve sleeve and wherein the valve sleeve has a lower pressure surface defined thereon so as to provide a second surface area upon which a second fluid pressure may act to provide an upward force on the valve sleeve;

a spring wherein the spring biases the valve sleeve to the closed position by exertion of a biasing force on the valve sleeve;

an upper pressure port in fluid communication with the internal housing flow path, said upper pressure port disposed to allow the first fluid pressure to act upon the upper pressure surface;

a lower pressure port that allows the second fluid pressure to act upon the lower pressure surface;

an elongated piston having a first end and a second end and axially movable within the valve housing, wherein the second end of the piston is adjacent one end of the valve sleeve and wherein the first end of the piston has a piston pressure surface characterized by a piston surface area; and a piston pressure port in fluid communication with the internal housing flow path that allows a fluid pressure internal to the valve to act upon the piston pressure surface.

2. The drill string flow control valve of claim 1 wherein the valve sleeve is capable of axially shifting from the closed position to the open position by a sufficient differential fluid pressure exerted on the valve sleeve so as to overcome the biasing force of the spring.

3. The drill string flow control valve of claim 1, wherein the piston surface area is smaller than the first surface area of the sleeve.

4. The drill string flow control valve of claim 1, wherein the sleeve is characterized by an outer diameter and the piston body is characterized by an outer diameter, wherein the piston body outer diameter is smaller than the outer diameter of the sleeve.

5. The drill string flow control valve of claim 1 wherein the piston pressure port is formed in the housing.

6. The drill string flow control valve of claim 1 wherein the upper pressure port is formed in the valve sleeve wall.

7. The drill string flow control valve of claim 1 further comprising an adjustment shim to allow for adjustment of a tension of the spring.

8. The drill string flow control valve of claim 1 wherein the spring has a spring constant sufficient to prevent u-tubing of fluid flow upon termination of a pumping force.

9. The drill string flow control valve of claim 1 wherein the upper pressure surface and the lower pressure surface comprise an extension protruding from the valve sleeve.

10. The drill string flow control valve of claim 1 wherein the lower pressure surface is an extension protruding from the valve sleeve.

11. The drill string flow control valve of claim 1 wherein the upper pressure surface comprises an extension protruding from the valve sleeve.

12. The drill string flow control valve of claim 1 wherein the spring acts upon the lower pressure surface to produce the biasing force on the valve sleeve.

13. The valve of claim 1, wherein the second end of the piston is disposed to bear against the valve sleeve.

14. The valve of claim 1, the valve sleeve further comprising a flow restriction in the sleeve interior, wherein said lower pressure port is disposed in the wall of the valve sleeve below the flow restriction.

15. The valve of claim 1, wherein said lower pressure port is disposed in the valve housing wall.

16. A drill string flow control valve comprising:

a valve housing, wherein the valve housing is characterized by a cylindrical wall extending from a first end to a second end and defining a valve interior, wherein the valve housing has an internal housing flow path channel formed between said first and second ends with a housing outlet flow port disposed along said flow path channel;

a valve sleeve disposed at least partially in the valve housing, the valve sleeve characterized by a valve sleeve wall having a sleeve flow port defined therein, wherein the valve sleeve is axially movable within the valve housing between a closed position and an open position, such that fluid flow between said housing outlet flow port and said sleeve flow port is substantially impeded when the valve sleeve is in the closed position and wherein the sleeve flow port and the housing outlet flow port are substantially aligned when in the open position;

wherein the valve sleeve has a first pressure surface defined thereon so as to provide a first surface area upon which a first fluid pressure from the housing flow path channel may act to provide a downward force on the valve sleeve, and wherein the valve sleeve has a second pressure surface defined thereon so as to provide a second surface area upon which a second fluid pressure may act to provide an upward force on the valve sleeve;

a biasing mechanism wherein the biasing mechanism biases the valve sleeve to the closed position;

a first pressure channel in fluid communication with the internal housing flow path channel, said first pressure channel disposed to allow the first fluid pressure to act upon the first pressure surface;

a second pressure channel that allows the second fluid pressure to act upon the second pressure surface;

an elongated piston having a first end and a second end and axially movable within the valve housing, wherein the first end of the piston has a piston pressure surface characterized by a piston surface area; and a piston pressure port in fluid communication with the internal housing flow path that allows a fluid pressure internal to the valve to act upon the piston pressure surface.

17. The drill string flow control valve of claim 16 wherein the sleeve is characterized by an outer diameter adjacent the piston and the elongated piston further comprises a radially extending flange adjacent the second end, wherein said flange has an outer diameter substantially the same as said sleeve outer diameter.

18. The drill string flow control valve of claim 16 wherein the second end of said piston comprises an engagement mechanism that engages the sleeve.

19. The valve of claim 16, wherein the second end of the piston is disposed to bear against the valve sleeve.

20. The valve of claim 16, the valve sleeve further comprising a flow restriction in the sleeve interior, wherein said lower pressure port is disposed in the wall of the valve sleeve below the flow restriction.

21. The valve of claim 16, wherein said lower pressure port is disposed in the valve housing wall.

22. A method for preventing u-tubing in a drill string comprising:

providing a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path;

providing a valve sleeve disposed at least partially in the valve housing, the valve sleeve having a sleeve flow port and a valve sleeve wall, wherein the valve sleeve is axially movable within the valve housing between a closed position and an open position, such that fluid flow between said housing outlet flow port and said sleeve flow port is substantially impeded when the valve sleeve is in the closed position and wherein the sleeve flow port and the housing outlet flow port are substantially aligned when in the open position, wherein the valve sleeve has an upper pressure surface defined thereon so as to provide a first surface area upon which a first fluid pressure may act to provide a downward force on the valve sleeve and wherein the valve sleeve has a lower pressure surface defined thereon so as to provide a second surface area upon which a second fluid pressure may act to provide an upward force on the valve sleeve;

providing a biasing mechanism wherein the biasing mechanism biases the valve sleeve to the closed position by exerting a biasing spring force on the valve sleeve;

providing an upper pressure port in fluid communication with the internal housing flow path, said upper pressure port disposed to allow the first fluid pressure to act upon the upper pressure surface from the internal housing flow path with a first force;

providing a lower pressure port that allows the second fluid pressure to act upon the lower pressure surface with a second force;

providing an elongated piston having a first end and a second end and axially movable within the valve housing, said first end of the piston having a piston pressure surface and said second end of the piston adjacent and end of the valve sleeve;

providing a piston pressure port in fluid communication with the internal housing flow path and that allows a fluid pressure internal to the valve to act upon the piston pressure surface;

introducing drilling fluid into the valve to induce a fluid pressure to be applied to the piston pressure surface via the piston pressure port, thereby causing said piston to urge the valve sleeve from a closed position;

increasing the fluid pressure upon the valve sleeve so as to cause the valve sleeve to axially move against the biasing direction of the spring, thereby increasing fluid flow through the housing outlet flow port and the sleeve flow port;

maintaining a drilling fluid flow through the valve sleeve so that the first force is greater than the biasing spring force plus the second force; and decreasing the fluid flow through the valve sleeve so as to allow the biasing mechanism to shift the valve sleeve from an open position to the closed position.

23. The method of claim 22 wherein the upper pressure port is in fluid communication with the internal flow path within the sleeve.

24. A drill string flow control valve system comprising:

a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path;

a valve sleeve disposed at least partially in the valve housing, the valve sleeve having a first end and a second end and characterized by a valve sleeve wall extending between said first and second ends, said valve sleeve having a sleeve flow port adjacent the first end, wherein the valve sleeve is axially movable within the valve housing between a closed position and an open position, such that fluid flow between said housing outlet flow port and said sleeve flow port is substantially impeded when the valve sleeve is in the closed position and wherein the sleeve flow port and the housing outlet flow port are substantially aligned when in the open position;

wherein the valve sleeve has an upper pressure surface defined thereon so as to provide a first surface area upon which a first fluid pressure from the internal housing flow path may act to provide a downward force on the valve sleeve, and wherein the valve sleeve has a lower pressure surface defined thereon so as to provide a second surface area upon which a second fluid pressure may act to provide an upward force on the valve sleeve;

a spring, wherein the spring biases the valve sleeve to the closed position by exertion of a biasing force on the valve sleeve;

an upper pressure port disposed in said valve sleeve wall between said sleeve flow port and the second end of said valve sleeve, said upper pressure port in fluid communication with the upper pressure surface, said upper pressure port disposed to allow the first fluid pressure to act upon the upper pressure surface, wherein the first fluid pressure is measured from within said valve housing;

a lower pressure port extending through the tubular wall of said valve housing so as to allow the second fluid pressure to act upon the lower pressure surface;

an elongated piston having a first end and a second end and axially movable within the valve housing, wherein the second end of the piston is adjacent an end of the valve sleeve and wherein the first end of the piston has a piston pressure surface characterized by a piston surface area; and a piston pressure port in fluid communication with the internal housing flow path that allows a fluid pressure internal to the valve to act upon the piston pressure surface.

25. The drill string flow control valve of claim 24, further comprising a plug disposed in the first end of said valve housing, said plug having a piston cylinder defined therein and wherein said piston pressure port is formed in said plug and in communication with said piston cylinder.

26. The drill string flow control valve of claim 25, wherein said elongated piston is at least partially disposed in said piston cylinder of said plug.

27. The drill string flow control valve of claim 25, wherein at least a portion of said internal housing flow path is formed between said plug and said valve housing tubular wall.

28. The drill string flow control valve of claim 24, wherein the piston surface area is smaller than the first surface area of the sleeve.

29. The drill string flow control valve of claim 24, wherein the sleeve is characterized by an outer diameter and the piston body is characterized by an outer diameter, wherein the piston body outer diameter is smaller than the outer diameter of the sleeve.

30. The valve of claim 24, wherein the second end of the piston is disposed to bear against the valve sleeve.

31. The valve of claim 24, the valve sleeve further comprising a flow restriction in the sleeve interior, wherein said lower pressure port is disposed in the wall of the valve sleeve below the flow restriction.

32. The valve of claim 24, wherein said lower pressure port is disposed in the valve housing wall.

33. A drill string flow control valve system comprising:

a valve housing formed of a tubular member extending from a first end to a second end and characterized by an external surface, said tubular member having a first flow path internally disposed therein;

a valve sleeve slidingly mounted in the valve housing;

a piston having a first end and a second end and slidingly mounted in the valve housing between said first end of the tubular member and said valve sleeve, wherein the second end of the piston is disposed to urge the valve sleeve axially relative to the valve housing;

a piston pressure port in fluid communication with the first internal housing flow path, said piston pressure port in fluid communication with the first end of said piston to allow a fluid pressure internal to the valve to act upon the first end of the piston;

a biasing mechanism for biasing the valve sleeve against the piston;

a first pressure port in the valve sleeve, said first pressure port in fluid communication with the internally disposed first flow path, said first pressure port in fluid communication with a first surface of the sleeve to provide a pressure acting on the first surface of the sleeve; and a second pressure port in fluid communication with a second surface of the sleeve to provide a pressure acting on the second surface of the sleeve.

34. The valve of claim 33, wherein the second end of the piston is disposed to bear against the valve sleeve.

35. The valve of claim 33, the valve sleeve further comprising a flow restriction in the sleeve interior, wherein said lower pressure port is disposed in the wall of the valve sleeve below the flow restriction.

36. A drill string flow control valve comprising:

a valve housing wherein the valve housing has an internal housing flow path with a housing outlet flow port disposed along said flow path;

a valve sleeve disposed at least partially in the valve housing, the valve sleeve having a sleeve flow port and a valve sleeve wall, wherein the valve sleeve is axially movable within the valve housing between a closed position and an open position, such that the valve sleeve wall substantially impedes fluid flow from the housing outlet flow port to the sleeve flow port when the valve sleeve is in the closed position and wherein the sleeve flow port and the housing outlet flow port are substantially aligned when in the open position;

wherein the valve sleeve has an upper pressure surface defined thereon so as to provide a first surface area upon which a first fluid pressure from the housing flow path may act to provide a downward force on the valve sleeve and wherein the valve sleeve has a lower pressure surface defined thereon so as to provide a second surface area upon which a second fluid pressure may act to provide an upward force on the valve sleeve;

a spring, wherein the spring biases the valve sleeve to the closed position by exertion of a biasing force on the valve sleeve;

an upper pressure port that allows the first fluid pressure to act upon the upper pressure surface;

a lower pressure port that allows the second fluid pressure to act upon the lower pressure surface; and an elongated piston body axially movable within the valve housing and disposed to bear against the valve sleeve.

37. The drill string flow control valve of claim 36, wherein the piston body has a piston pressure surface characterized by a piston surface area; and a piston pressure port that allows the first fluid pressure to act upon the piston pressure surface.

38. The drill string flow control valve of claim 37, wherein the piston surface area is smaller than the first surface area of the sleeve.

39. The drill string flow control valve of claim 37, wherein the sleeve is characterized by an outer diameter and the piston body is characterized by an outer diameter, wherein the piston body outer diameter is smaller than the outer diameter of the sleeve.

40. The drill string flow control valve of claim 37, further comprising a plug disposed in a first end of said valve housing, said plug having a piston cylinder defined therein and said piston pressure port is formed in said plug and in communication with said piston cylinder, wherein said elongated piston is at least partially disposed in said piston cylinder of said plug.

41. The drill string flow control valve of claim 40, wherein at least a portion of said internal housing flow path is formed between said plug and said valve housing tubular wall.

42. The drill string flow control valve of claim 37 wherein the sleeve is characterized by an outer diameter adjacent the piston and the elongated piston further comprises a radially extending flange adjacent the second end, wherein said flange has an outer diameter substantially the same as said sleeve outer diameter.

43. The drill string flow control valve of claim 42, wherein said flange has at least one bore passing therethrough.

44. The drill string flow control valve of claim 36, wherein the upper pressure port is in fluid communication with the internal housing flow path.

45. The drill string flow control valve of claim 44, wherein the upper pressure port is formed in the valve sleeve wall.

46. The drill string flow control valve of claim 44, wherein the upper pressure port is formed in the valve housing and extends to the upper pressure surface from upstream of said housing outlet flow port.

47. A method for preventing u-tubing in a drill string comprising:

providing a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path;

providing a valve sleeve disposed at least partially in the valve housing, the valve sleeve having at least two pressure surfaces and axially movable within the valve housing between a closed position and an open position, providing a piston within the valve housing and bearing against the valve sleeve;

biasing the valve sleeve under a biasing force in a first direction against the piston so as to close the valve;

introducing drilling fluid into the valve housing to induce a fluid pressure therein;

initiating fluid flow through the valve housing by causing said first fluid pressure to be applied to the piston pressure surface, thereby causing said piston to urge the valve sleeve in a second direction opposite the first direction;

applying a fluid pressure from within the valve housing to a first surface of the valve sleeve to generate a first force to urge the valve sleeve in the second direction;

applying a fluid pressure from external to the valve housing to a second surface of the valve sleeve to generate a second force to urge the valve sleeve in the first direction;

maintaining a drilling fluid flow through the valve sleeve so that the first force is greater than the biasing spring force plus the second force; and decreasing the fluid flow through the valve sleeve so as to allow the biasing force to shift the valve sleeve in the first direction, thereby urging the valve into a closed position.

* * * * *